US006978480B2

(12) United States Patent
Grilliot et al.

(10) Patent No.: US 6,978,480 B2
(45) Date of Patent: Dec. 27, 2005

(54) PROTECTIVE GARMENT, AS FOR FIREFIGHTER, WITH DIFFERENT FRONT AND BACK PROPERTIES

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/790,392

(22) Filed: Mar. 1, 2004

(65) Prior Publication Data

US 2004/0226070 A1 Nov. 18, 2004

Related U.S. Application Data

(63) Continuation-in-part of application No. 10/437,599, filed on May 14, 2003, now abandoned.

(51) Int. Cl.[7] ..... A41D 11/00

(52) U.S. Cl. ..... 2/81; 2/84

(58) Field of Search ..... 2/69, 81, 92, 93, 2/84, 456–459

(56) References Cited

U.S. PATENT DOCUMENTS

| | | | | |
|---|---|---|---|---|
| 3,691,564 | A * | 9/1972 | La Marre et al. | 2/458 |
| 4,890,336 | A * | 1/1990 | Worton | 2/79 |
| 4,972,520 | A * | 11/1990 | Grilliot et al. | 2/5 |
| 5,001,781 | A * | 3/1991 | Grilliot et al. | 2/69 |
| 5,090,054 | A * | 2/1992 | Grilliot et al. | 2/5 |
| 6,364,980 | B1 * | 4/2002 | Smith et al. | 156/108 |
| 6,662,375 | B2 * | 12/2003 | Lewis | 2/202 |
| 6,766,534 | B2 * | 7/2004 | Lewis et al. | 2/84 |
| 6,782,556 | B2 * | 8/2004 | Grilliot et al. | 2/202 |
| 2003/0019009 | A1 * | 1/2003 | Feduzi et al. | 2/69 |
| 2003/0204894 | A1 | 11/2003 | Lewis | |
| 2004/0019957 | A1 | 2/2004 | Lewis et al. | |

* cited by examiner

*Primary Examiner*—Gary L. Welch
(74) *Attorney, Agent, or Firm*—Wood, Phillips, Katz, Clark & Mortimer

(57) ABSTRACT

A protective garment, such as a coat, trousers, overalls, or coveralls, for a firefighter or an emergency worker, has a front portion and a back portion. The back portion is breathable to allow air to pass through the back portion, whereas substantially the entire front portion includes a continuous, fluid-impervious, heat-reflective layer, such as an aluminized, polyester film.

12 Claims, 1 Drawing Sheet

PROTECTIVE GARMENT, AS FOR FIREFIGHTER, WITH DIFFERENT FRONT AND BACK PROPERTIES

CROSS-REFERENCE TO RELATED APPLICATION

This application is a continuation-in-part of U.S. patent application Ser. No. 10/437,599, which was filed on May 14, 2003 now abandoned, and the disclosure of which is incorporated herein by reference.

TECHNICAL FIELD OF THE INVENTION

This invention pertains to a protective garment, such as a coat, trousers, overalls, or coveralls, for a firefighter or an emergency worker. This invention contemplates that a back portion of the garment is breathable and substantially all of a front portion of the garment includes a continuous, fluid-impervious, heat-reflective layer.

BACKGROUND OF THE INVENTION

Commonly, a protective garment, such as a coat, trousers, overalls, or coveralls, for a firefighter or an emergency worker has plural layers, which provide the protective garment with protective properties, such as abrasion resistance, puncture resistance, thermal protection, and water repellence, which protect the firefighter or emergency worker against injury, which protect the protective garment against damage, or which protect both.

Commonly, an outer layer, which may be also called a shell, provides the protective garment with abrasion resistance and with puncture resistance, while inner liners provide the protective garment with a moisture and with thermal protection. Commonly, the shell has a water-repellent finish, such as a perfluorohydrocarbon finish, which provides the protective garment with water repellence. Non-continuous, vapor-permeable, retroreflective sections have also been provided on such garments, as exemplified in United States Patent Application Publication No. US 2003/0019009 A1.

SUMMARY OF THE INVENTION

This invention provides, for a firefighter or an emergency worker, a protective garment having a front portion and a back portion. The back portion is breathable to allow air and water vapor to pass through the back portion, whereas the front portion includes a fluid-impervious, heat-reflective layer, which is continuous from a region at or near a top of the garment to a region at or near a bottom of the garment.

In one contemplated embodiment, substantially the entire front portion of the protective garment includes the continuous fluid-impervious, heat-reflective layer. Both the front and back portions may comprise breathable moisture and thermal barriers, with the heat-reflective layer overlying the barriers over substantially the entire front portion. The heat-reflective layer may be an aluminized layer, such as an aluminized polyester film.

DETAILED DESCRIPTION OF THE ILLUSTRATED EMBODIMENT

Figure 1:
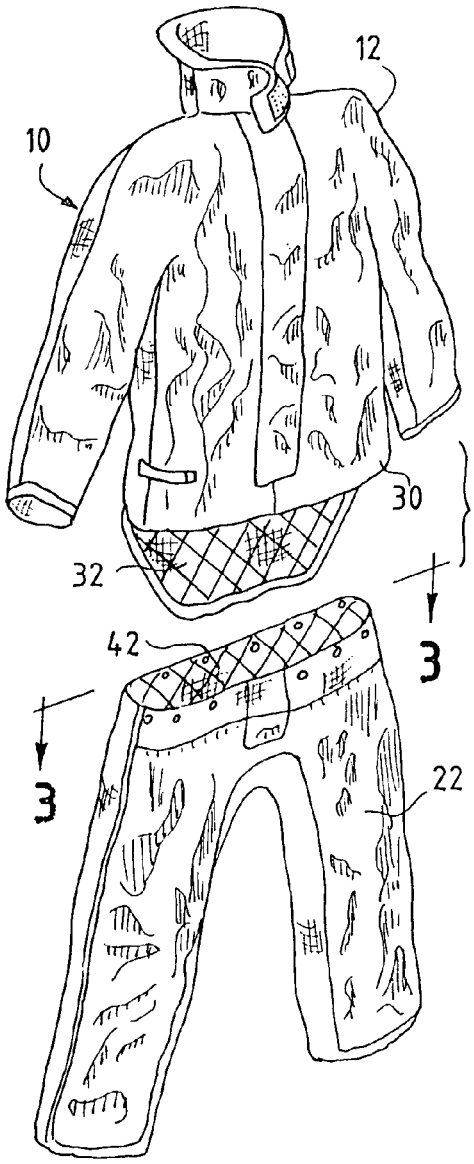
FIG. 1 is a perspective view of two protective garments embodying this invention, namely, a protective coat and protective trousers, as seen from a front vantage.

As illustrated, this invention is embodied in two protective garments, namely, a protective coat 10 and protective trousers 20, which are worn with the protective coat 10. Except as illustrated and described herein, the protective garments 10, 20, are similar to protective garments known heretofore and available commercially from Morning Pride Manufacturing, L.L.C. of Dayton, Ohio, and from other sources. This invention may be also embodied in a protective garment of a different type, such as overalls or coveralls.

The protective coat 10 has a front portion 12 and a back portion 14. The protective trousers 20 have a front portion 22 and a back portion 24. When the protective garments 10, 20, are worn by a standing wearer, such as the firefighter illustrated in FIG. 2, the front portions 12, 22, face frontwardly and the back portions 14, 24, face backwardly. The front portions 12, 22, have a common set of protective properties and the back portions 14, 24, have a common set of protective properties.

The protective coat 10 has a shell 30, which is made from a fabric woven from an aramid, a polybenzamidazole, or an aramid-polybenzamidazole blend, and the protective trousers 20 have a shell 40, which is made from the same fabric. The shells 30, 40, provide the protective garments 10, 20, with two protective properties, namely, abrasion resistance and puncture resistance. The protective coat 10 has an inner, quilted, thermally insulative liner 32 and the protective trousers 20 have a similar, thermally insulative liner 42. The thermally insulative liners 32, 42, provide the protective garments 10, 20, with another protective property, namely, thermal protection.

The shells 30, 40, the thermally insulative layers 32, 42, or both are provided, on their outer surfaces, with a water-repellent finish, such as a perfluorohydrocarbon finish, which provides the protective garments 10, 20, with another protective property, namely, water repellence. The perfluorohydrocarbon finish may be a TEFLON finish, which is available commercially from E.I. DuPont de Nemours & Co., Inc. of Wilmington, Del., or a SCOTCHGUARD finish, which is available commercially from Minnesota Mining and Manufacturing Co. of St. Paul, Minn. Alternatively or additionally, each of the protective garments 10, 20, may have an intermediate liner (not shown) providing a moisture barrier.

According to a preferred embodiment of this invention, the front portion 12 of the protective coat 10 and the front portion 22 of the protective trousers 20 include a continuous, uninterrupted, fluid-impervious, heat-reflective, outer layer. This layer may be formed, for example, by aluminizing the front portion 12 (e.g., by providing a layer of aluminized polyester film, such as aluminized Mylar®).

The back portion 14 of the protective coat 10 and the back portion 22 of the protective trousers 20 are not aluminized and, therefore, are breathable to allow air and water vapor to pass through the back portions 14,24. Being aluminized, the front portion 12 of the protective coat 10 and the front portion 22 of the protective trousers 20 have protective properties, which the back portion 14 of the protective coat

10 and the back portion 24 of the protective trousers 20 do not have, namely, fluid-imperviousness and heat-reflectivity.

Figure 2:
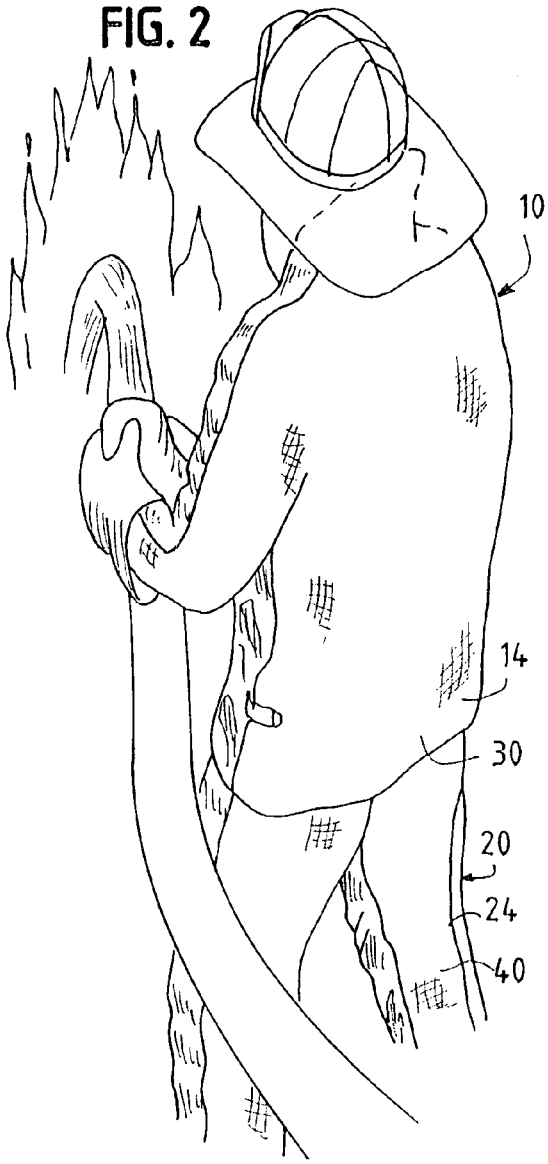
FIG. 2 is a perspective view of a firefighter wearing the protective garments, as seen from a back vantage.
Figure 3:
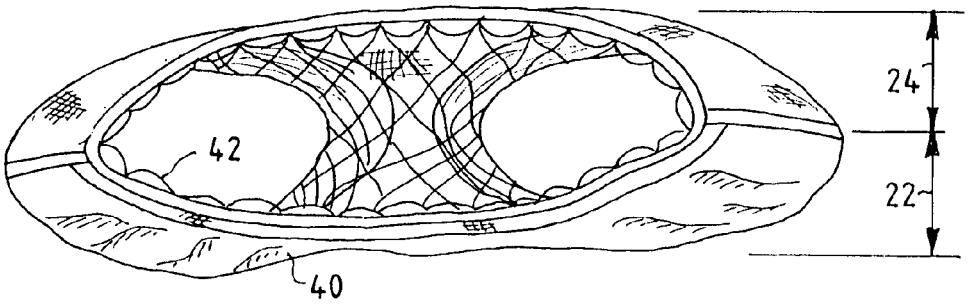
FIG. 3 is an enlarged, perspective view of the protective trousers, as taken along line 3—3 of FIG. 1, in a direction indicated by arrows.

As illustrated in FIG. 2, a firefighter wearing the protective garments 10, 20, tends to face a fire that he or she is fighting. Hence, it is advantageous for the front portions 12, 24, of the protective garments 10, 20, to be heat-reflective and fluid-impervious, while the breathability of the back portions 14, 24, still permit the garments 10, 20 to be worn comfortably.

What is claimed is:

1. For a firefighter or an emergency worker, a protective garment having a back portion, which is breathable to allow air and water vapor to pass through the back portion, and a front portion including a fluid-impervious, heat-reflective layer, which is continuous from a region at or near a top of said garment to a region at or near a bottom of said garment, wherein both said front and back portions comprise breathable moisture and thermal barriers, said heat-reflective layer overlying said barriers, over substantially the entire front portion.

2. The garment of claim 1, wherein said heat-reflective layer also is continuous from a region at or near one side of said front portion to a region at or near the other side of said front portion.

3. The garment of claim 1, wherein said garment comprises a coat having two shoulders and having a bottom edge, wherein the top of the said heat-reflective layer is at or near the shoulders, and wherein the bottom of said heat-reflective layer is at or near the bottom edge.

4. The garment of claim 3, wherein said coat includes a closable front opening between opposite sides, and wherein said continuous heat-reflective layer extends across said opening.

5. The garment of claim 1, wherein said heat-reflective layer comprises an aluminized layer.

6. The garment of claim 5, wherein said aluminized layer comprises aluminized, polyester film.

7. For a firefighter or an emergency worker, a protective garment having a front portion and a back portion, the back portion being breathable to allow air and water vapor to pass through the back portion, substantially the entire front portion including a continuous, fluid-impervious, heat-reflective layer, wherein both said front and back portions comprise breathable moisture and thermal barriers, said heat-reflective layer overlying said barriers, over substantially the entire front portion.

8. The garment of claim 7, wherein said heat-reflective layer comprises an aluminized layer.

9. The garment of claim 8, wherein said aluminized layer comprises aluminized, polyester film.

10. The garment of claim 7, wherein said garment front portion extends from a region at or near a top of said garment to a region at or near a bottom of said garment, and from a region at or near one side of said garment to a region at or near the other side of said garment.

11. The garment of claim 10, wherein said garment comprises a coat having two shoulders and having a bottom edge, wherein the top of said heat-reflective layer is at or near the shoulders, and wherein the bottom of said heat-reflective layer coat is at or near the bottom edge.

12. The garment of claim 11, wherein said coat includes a closable front opening between said garment sides.

* * * * *